United States Patent [19]

Cheney et al.

[11] 4,025,334

[45] May 24, 1977

[54] TUNGSTEN CARBIDE-COBALT FLAME SPRAY POWDER AND METHOD

[75] Inventors: Richard Frank Cheney; William Daniel Lafferty, both of Towanda; George Jacob Long, Wyalusing, all of Pa.

[73] Assignee: GTE Sylvania Incorporated, Stamford, Conn.

[22] Filed: Apr. 8, 1976

[21] Appl. No.: 674,961

[52] U.S. Cl. ..... 75/.5 R; 428/546; 75/252; 106/1; 75/.5 AC; 75/.5 BC

[51] Int. Cl.[2] ..... B22F 1/00; C23C 7/00

[58] Field of Search ..... 75/.5 R, .5 AC, .5 BC; 106/1; 29/192 R, 192 CP, 191.2

[56] References Cited

UNITED STATES PATENTS

| | | | |
|---|---|---|---|
| 3,211,386 | 10/1965 | Frehn | 75/.5 BC |
| 3,305,326 | 2/1967 | Longo | 29/192 R |
| 3,419,415 | 12/1968 | Dittrich | 29/192 R |
| 3,606,359 | 9/1971 | McCormick | 75/.5 R |
| 3,890,137 | 6/1975 | Beyer et al. | 75/.5 R |
| 3,907,546 | 9/1975 | Port et al. | 29/192 CP |
| 3,936,295 | 2/1976 | Cromwell et al. | 75/.5 R |

*Primary Examiner*—W. Stallard

*Attorney, Agent, or Firm*—Norman J. O'Malley; John C. Fox; Donald R. Castle

[57] ABSTRACT

Tungsten carbide-cobalt agglomerated flame spray powder is produced by spray drying a slurry of particles in an aqueous cobalt nitrate solution. The agglomerates are classified according to size and the out-of-size agglomerates are recycled. The classified agglomerates are heated in flowing hydrogen, to reduce the nitrate to cobalt metal, and then sintered to strengthen the agglomerates for subsequent flame spraying.

13 Claims, No Drawings

TUNGSTEN CARBIDE-COBALT FLAME SPRAY POWDER AND METHOD

BACKGROUND OF THE INVENTION

This invention relates to flame spray powders, and more particularly relates to tungsten carbide-cobalt agglomerated powders utilizing cobalt nitrate as a binder, and also relates to a method for producing such powders.

Generally speaking, powder for use with flame spray coating equipment must have a narrow size distribution and must be relatively free flowing. (As used herein the term "flame spray" is meant to refer generically to both flame spray and plasma spray). The narrow size range is necessary if all particles are to be heated uniformly. The flow is to enable a uniform and controllable feed through the small diameter tubes and orifices of the equipment.

Tungsten carbide is commonly made by reacting tungsten powder or tungsten oxide with carbon at high temperatures. The result is a powder of average diameter less than about 10 micrometers and typically less than about 5 micrometers which has very poor flow. To achieve good flow, such powders must be agglomerated by one of several processes well known to the art. Such processes typically use an organic binder of some sort, such as paraffin or one of the many organic waxes, to hold the agglomerates together.

The organic binders have two main disadvantages. First, they must be removed prior to final processing or use of the powder or part made therefrom. Complete removal is difficult and time consuming. Second, the agglomerates are not very strong. When powders are blended or sifted they tend to deagglomerate, and to plug the sifting screens. Also, when stored in warm areas, the powder particles fuse together because of softening of the binders.

When working with molybdenum and tungsten powders, it was recently discovered that ammonium molybdate and ammonium tungstate added to an aqueous slurry of molybdenum or tungsten powder would act as a binder of the powder being agglomerated. When the slurry is spray dried, the ammonium molybdate or ammonium tungstate is well distributed throughout the interstices of the dried agglomerate and provides a strong bond for subsequent operations. A subsequent reduction reaction permits conversion of the ammonium salt to pure metal which still acts as a good binder because of surface-to-surface bonding promoted between the metal paticles at the reduction and/or heat treatment temperature.

For hard, wear resistant surfaces, tungsten carbide, WC, is usually mixed intimately with about 4 to 20 weight percent of cobalt powder and flame sprayed to form a coating. Normally, the cobalt is agglomerated along with the WC as previously described prior to flame spraying.

Replacing the organic binders normally used in spray drying would be desirable for the reason already stated. However, ammonium tungstate reacts with cobalt to form a gel or large particle size precipitate, which would hinder the spray drying operation. Ammonium complexes of WC and/or cobalt are either nonexistent, not readily available commercially or chemically unstable. Many other soluble salts, either tend to evolve large amounts of gases during the decomposition heat treatment (carbonates, oxylates and oxychlorides), or leave contaminating residues (sulfates, silicates and boron containing compounds such as borax or boric acid), or are corrosive (chlorides, oxychlorides).

Furthermore, any soluble salt used as a binder must be compatible with the processing of the tungsten carbide-cobalt powder, that is, it must be capable of being removed or decomposed without promoting substantial decarburization of the WC.

SUMMARY OF THE INVENTION

In accordance with the invention, it has now been discovered that in the agglomeration of WC particles and particles of cobalt or reducible cobalt compounds such as cobalt oxide to form flame spray powders, part of the cobalt can be added as cobalt nitrate, which acts as a binder when a slurry of the particles in an aqueous solution of the cobalt nitrate is spray dried, and the cobalt nitrate may be reduced to metallic cobalt without significant decarburization of the WC particles.

Furthermore, the cobalt nitrate is sufficiently strong and well distributed as a binder in the spray dried agglomerates to permit normal size classification such as by sieving or screening to obtain the desired size fraction. The out-of-size agglomerates can then be deagglomerated by reslurrying them in water, (resulting in dissolution of the cobalt nitrate) and repeating the spray drying cycle again, thereby avoiding the need for a separate binder removal step.

The cobalt nitrate may be reduced to cobalt metal either by carrying out flame spraying under reducing conditions or carrying out a separate reducing heat treatment prior to flame spraying.

In accordance with a preferred embodiment, the spray dried powder is subjected to a reducing step and a sintering step to further strengthen and densify the agglomerates prior to flame spraying.

Elemental carbon and/or tungsten powder may be added to the slurry prior to spray drying, or to the spray dried agglomerates prior to reduction and/or sintering, in order to adjust or compensate for shifts in the stoichiometry of the WC during processing. Cobalt may be introduced as an insoluble chemically reducilbe compound of cobalt, such as cobalt oxide, which can then be reduced subsequently when the soluble cobalt nitrate binder is reduced.

DESCRIPTION OF THE PREFERRED EMBODIMENTS

For a better understanding of the present invention, together with other and further objects, advantages and capabilities thereof, reference is made to the following disclosure and appended claims in connection with the above-description of some of the aspects of the invention.

In the formation of WC-cobalt flame spray powder, cobalt is normally present in the amount of from about 4 to 20 weight percent of the total weight of the powder. From about 2 to about 50 percent by weight of the cobalt may be introduced as the soluble salt, cobalt nitrate, below which insufficient binding action occurs during spray drying and subsequent to spray drying, and above which amount the agglomerate density and strength are adversely affected.

As already stated, the starting materials may additionally include elemental carbon and/or tungsten powder in order to compensate for shifts in stoichiometry during processing. For example, despite the precautions taken during processing, usually carbon is removed to a slight extent during the reduction step in which cobalt nitrate is reduced to cobalt. This usually amounts to at most about several tenths of one percent by weight and can be compensated by adding the appropriate amount of carbon at some point during the processing, preferably to the starting materials prior to slurrying or spray drying.

The starting materials are intimately mixed, such as by ball milling or attritor milling, and slurried in the cobalt nitrate solution. Preferably the amount of powder particles in slurry and solution is from about 50 to 85 weight percent, below which the removal of the excess water in the slurry is an additional expense and particle size control becomes difficult and above which the slurry becomes too viscous to easily pass through the spray nozzle. The concentration of cobalt nitrate in solution should be from about 10 grams per liter to 1000 grams per liter, below which insufficient binding action occurs during and subsequent to spray drying, and above which the agglomerate density and strength are adversely affected.

Spray drying may be carried out using commercially available spray drying equipment. The inlet and outlet air temperatures should be maintained below 370° C and 190° C respectively, to prevent substantial oxidation or decarburization of the slurry constituents, or decomposition of the cobalt nitrate.

The spray dried agglomerates may then be classified, usually by sieving or screening, in order to obtain a desired particle size distribution, typically within about 60 micrometers and preferably 80 percent within 30 micrometers, for flame spraying application.

Following classification by screening to obtain the desired size fraction, out-of-size material may be deagglomerated by reslurrying in water to dissolve the cobalt nitrate binder, and the spray drying cycle repeated.

The classified agglomerates may be reduced by a separate heat treating step prior to flame spraying, such as by heating in flowing hydrogen or other reducing gas at a temperature of at least about 400° C, which is sufficient to reduce oxygen from the nitrate to low levels, for example 0.1 weight percent, above which significant decarburization could occur during any subsequent sintering step or during flame spraying. The reduction temperature should not exceed about 900° C, above which significant decarburization could occur in the presence of even trace amounts of water vapor and/or oxidizing contaminants. Reducing times may be from about ½to 24 hours, the shorter times corresponding to higher temperatures.

It has been found that the spray dried powders of the invention normally possess sufficient green strength to withstand such handling for size classification and reduction. However, it may be desired as an optional step to heat treat the agglomerates for purposes of further strengthening or densification. Of course, such treatment should be carried out under conditions to prevent formation of an unusable mass by substantial diffusion bonding of the agglomerates to one another. Such sintering is preferably carried out at a temperature within the range of about 1100° to 1350° C for about 5 to 120 minutes, in a neutral or nonoxidizing atmosphere in order to prevent decarburization of the WC. Following such sintering it may be desired to further screen the material to remove or breakup only cakes or chunks of material which may have formed. A 100 mesh screen has been found suitable for such purposes.

Of course it is unnecessary that the spray dried agglomerates be subjected to separate reducing and sintering heat treatments. For certain applications, the spray dried agglomerates may be flame sprayed per se under reducing conditions in order to directly convert the spray dried agglomerates to a flame spray coating containing typically WC, $W_2C$, metallic cobalt, and several Co C-W compounds.

The following examples are presented to further illustrate the practice of the invention:

EXAMPLE I 44 pounds of tungsten carbide, 6.77 pounds of cobalt oxide and 8.2 liters of water were milled for one-half hour in a commercially available attritor mill. Tungsten carbide balls, 174 inch in diameter, were used as the milling medium. 3.34 pounds of cobalt nitrate were then dissolved in this milled slurry and the slurry was spray dried in a Proctor-Schwartz dryer using a two-fluid nozzle. The inlet air temperature was 600° C and the outlet air temperature was 360° C. The resulting spray dried agglomerates were screened into two size fractions, the first being within the range of −325 mesh to +10 micrometers and the second within the range of −170 to +325 mesh. The oversize powder was reslurried for another spray drying cycle.

The agglomerates within the desired size fractions were then heated in flowing hydrogen at 725° C for 3½hours to reduce the cobalt oxide and cobalt nitrate to metallic cobalt. The reduced agglomerates were then further heated in hydrogen at 1230° C for one forth hours to strengthen and densify the agglomerates by sintering. The powder was then passed through a 100 mesh screen to breakup cakes of agglomerates which had formed. Hall flow was measured of 50 grams samples for both fractions and was 32 seconds for the −325 mesh fraction and 15 seconds for the −170 +325 mesh fraction. Such Hall flow values represent good to excellent flowability for such flame spray powders.

EXAMPLE II

The procedure of Example I was repeated except that the carbon level was lowered from 5.3 to 4 weight percent by adding tungsten powder to the starting material. Thus, the starting materials were 159 pounds of WC, 35.5 pounds of cobalt oxide, 61 pounds of tungsten and 10.5 pounds of cobalt nitrate. Again the resulting powder exhibited good flowability as evidenced by Hall flow values on 50 gram samples of 14 seconds and 30 seconds for the −325 and −170 +325 mesh fractions, respectively.

While there has been shown and described what are at present considered the preferred embodiments of the invention, it will be obvious to those skilled in the art that various changes and modifications may be made therein without departing from the scope of the invention as defined by the appended claims.

What is claimed is:

1. A flame spray powder comprising agglomerates consisting essentially of particles of at least one member selected from a first group consisting of WC, W, and C, and at least one member selected from a second group consisting of Co and an aqueous insoluble chemically reducible cobalt compound, the agglomerate particles held together by a binder consisting essentially of spray dried cobalt nitrate.

2. The flame spray powder of claim 1 in which the total cobalt from all sources is present in an amount equivalent to elemental cobalt of from about 4 to 20 weight percent.

3. The flame spray powder of claim 2 in which from about 2 to 50 weight percent of the cobalt is present in the form of cobalt nitrate.

4. The flame spray powder of claim 1 in which the aqueous insoluble chemically reducible cobalt compound is cobalt oxide.

5. The flame spray powder of claim 1 in which the aqueous insoluble chemically reducible cobalt compound and cobalt nitrate have been substantially reduced to cobalt metal.

6. A method for producing a flame spray powder comprising:

a. forming a slurry of particles in an aqueous cobalt nitrate solution, the particles being selected from at least one member of a first group consisting essentially of WC, W, and C, and at lest one member of a second group consisting of CoO and an aqueous insoluble chemically reducible cobalt compound; and b. spray drying the slurry in a spray dryer having a first inlet air temperature and a second outlet air temperature, to bind the particles into spray dried agglomerates with the cobalt nitrate.

7. The method of claim 6 in which the inlet air temperature is below 370° C and the outlet air temperature is below 190° C.

8. The method of claim 6 in which the amount of particles in the solution is from about 50 to 85 weight percent.

9. The method of claim 6 in which the cobalt nitrate is present in the solution at a concentration of about 10 to 1000 grams per liter.

10. The method of claim 6 in which the spray dried agglomerates are heated at a temperature of from 400° C to 900° C in a reducing atmosphere for a time of from ½to 24 hours, to substantially reduce the cobalt compounds to metallic cobalt.

11. The method of claim 6 in which the spray dried agglomerates are heated at a temperature of from 1100° to 1350° C for a time of 5 to 120 minutes in a reducing atmosphere, to strengthen and densify the agglomerates by sintering.

12. The method of claim 6 in which the spray dried agglomerates are classified according to size by screening.

13. The method of claim 6 in which the aqueous insoluble chemically reducible cobalt compound is cobalt oxide.

* * * * *